United States Patent [19]

Gamache

[11] 4,128,350

[45] Dec. 5, 1978

[54] APPLICATOR ATTACHMENT

[76] Inventor: Robert J. Gamache, 33185 W. Warren, Westland, Mich. 48135

[21] Appl. No.: 543,428

[22] Filed: Jan. 23, 1975

[51] Int. Cl.[2] ..... B05C 17/00; B43M 11/02; B44D 3/28

[52] U.S. Cl. ..... 401/208

[58] Field of Search ..... 401/208, 218, 219, 220, 401/21, 188, 197; 118/258, 259

[56] References Cited

U.S. PATENT DOCUMENTS

| | | | |
|---|---|---|---|
| 2,582,861 | 1/1952 | Coombs | 401/208 |
| 2,892,202 | 6/1959 | Williams | 401/208 |
| 2,957,191 | 10/1960 | Harris | 401/208 |
| 3,104,413 | 9/1963 | Nelson | 401/208 X |
| 3,196,479 | 7/1965 | Romoser | 401/208 |
| 3,848,565 | 11/1974 | Schweppe | 118/259 X |

*Primary Examiner*—Stephen C. Pellegrino
*Attorney, Agent, or Firm*—Whittemore, Hulbert & Belknap

[57] ABSTRACT

An applicator attachment for facilitating application of cosmetics such as suntan lotion and the like comprising a body member having a threaded opening for attachment to a threaded opening in a cosmetic container, a slot in the body member, a metering channel for connecting the threaded opening to the slot, a roller having substantially the same but slightly larger dimensions than the slot rotatably mounted on the body member in the slot and extending radially out of the slot, and a cover for the applicator attachment removably secured to the body member over the slot.

9 Claims, 5 Drawing Figures

FIG. 1
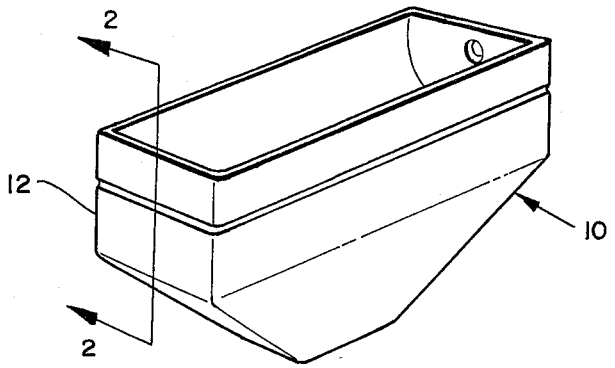
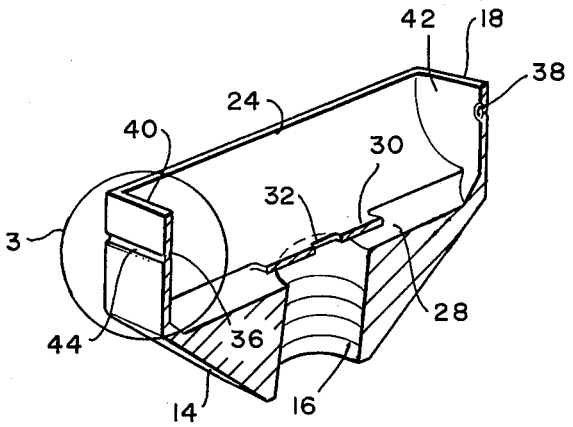
FIG. 2
FIG. 3
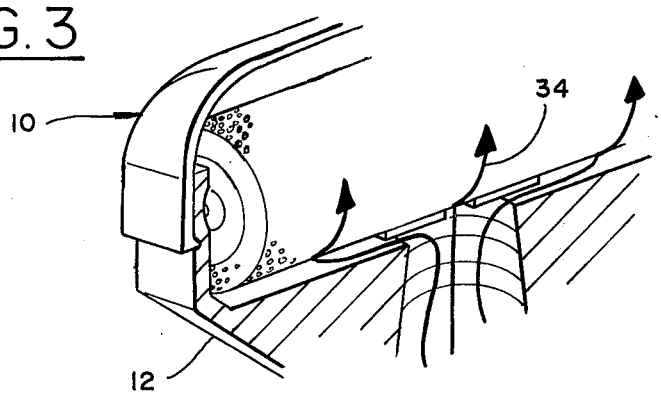

APPLICATOR ATTACHMENT

BACKGROUND OF THE INVENTION

1. Field of the Invention

The invention relates to applicator structures and refers more specifically to an applicator attachment for securing to a cosmetic container in place of a cap therefor to facilitate application of the cosmetic to a body portion by means of a roller.

2. Description of the Prior Art

In the past, applicators for cosmetics and the like have generally been either integral with a cosmetic container such as the rotating ball for deoderants and the like or the spraying mechanism for aerosol cans. Also, applicators have in the past been of the type completely removable from the container which are removed and replaced each time the cosmetic is applied. Such applicators are used with shoe polish, shaving cream and the like. These applicators are undesirable, since with the first type, a new applicator must be manufactured with each container of cosmetic. With the second type of applicator indicated above, the applicator must be removed and replaced each time the cosmetic is used.

SUMMARY OF THE INVENTION

The invention comprises an applicator attachment for containers for cosmetics such as suntan lotion. The applicator attachment includes a body member having a threaded opening adapted to be screwed onto a cosmetic container after removal of the cap from the container, a metering channel in communication with the threaded opening, and a slot in communication with the metering channel. A partition is provided across the center third of the slot in the body member and arcuate sides extend from the sides of the metering channel to the sides of the slot and a roller is rotatably mounted on the body member in the slot which extends radially outwardly of the slot. The roller has a diameter and length substantially the same as but slightly greater than the length and width of the slot. A cover and means for securing the cover to the body member over the slot and the roller mounted therein is also part of the applicator attachment.

With such structure the applicator attachment need be placed on the cosmetic container only once after removing the top from the container and is ready for instant application of the cosmetic at any time until no more cosmetic is in the container. When the container is empty the applicator can be unscrewed from the cosmetic container and applied to a subsequent cosmetic container.

BRIEF DESCRIPTION OF THE DRAWINGS

FIG. 1 is a perspective view of the body member of the applicator attachment of the invention.

FIG. 2 is a perspective view of a section of the body member of the applicator attachment, taken substantially on the line 2—2 in FIG. 1.

FIG. 3 is an enlarged partial section view of a portion of the applicator attachment of the invention, taken substantially in the area designated 3 in FIG. 2.

DESCRIPTION OF THE PREFERRED EMBODIMENTS

Figure 4:
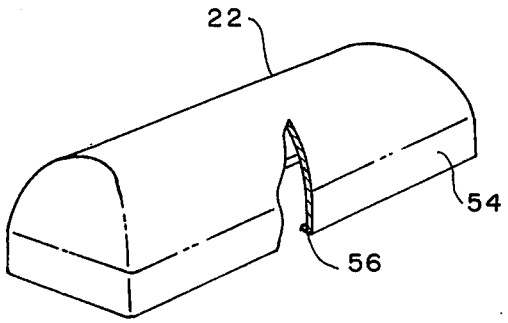
FIG. 4 is a broken perspective view of the cover for the applicator attachment illustrated in FIGS. 1-3.

The applicator attachment 10 as shown in FIG. 3 includes the body member 12 having a portion 14 with a threaded opening 16 therethrough adapted to fit onto a container for cosmetics or the like (not shown) in place of the cap thereof and having a roller receiving portion 18, a roller 20 and a cover 22.

As shown best in FIGS. 1 and 2, the body member 12 is constructed of relatively rigid material such as a suitable plastic having the threaded opening 16 in the portion 14 thereof and including a slot 24 in the portion 18 thereof. A metering channel 28 connects the threaded opening 16 with the slot 24 and extends longitudinally of the slot 24 for substantially the entire length thereof. A partition 30 extends across the central third of the metering channel 28 and has an opening 32 therein. Thus, cosmetics may be metered to both end thirds and the central portion of the roller 20 through the metering channel 28 from the opening 16 as shown best by the arrows 34 in FIG. 3.

A pair of hemispherical bearing recesses 36 and 38 are provided in the opposite end walls 40 and 42 of the body member 12 to rotatably mount the roller 20. In addition, a retaining groove 44 is provided about the periphery of the slot 24 in the upper edge of the body member 12 for use in retaining the cover 22 thereon as shown best in FIG. 3.

Figure 5:
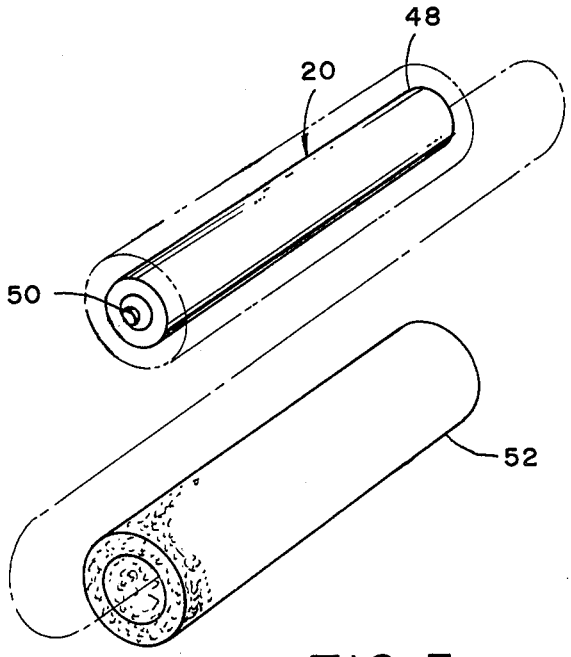
FIG. 5 is an exploded view of the roller of the applicator attachment illustrated in FIGS. 1-4 illustrating the direction of assembly of and the hollow cylinder portion of the roller assembled on the roller core in phantom.

The roller 20 as shown best in FIG. 5 includes a relatively rigid cylindrical core 48 having hemispherical bearing bosses 50 at the opposite ends thereof adapted to fit into the hemispherical bearing recesses 36 and 38 in the body member 12 with the roller in assembly with the body member 12 to rotatably mount the roller in the slot 24 on the body member 12.

Roller 20 further includes a hollow cylindrical portion 52 of relatively resilient material such as foam rubber sleeved over the core 48. The cylindrical portion 52 has a diameter slightly greater than the width of the slot 24 and a length slightly greater than the length of the slot 24 whereby in assembly with the body member the roller is slightly compressed both across its diameter and along its length to seal the cosmetic within the applicator attachment 10. Also, the internal diameter of the hollow cylinder 52 is slightly less than the external diameter of the core 20 so that the cylinder 52 is tightly held in the core 20.

The cover 22 as shown best in FIG. 4 is generally bubble-shaped and includes the downwardly extending flange 54 having the retaining lip 56 thereon extending inwardly thereof. As indicated above, the lip 58 extends into and cooperates with the groove 44 on the body member 12 to secure the cover 22 to the body member 12 as shown in FIG. 3.

While it is presently anticipated that the applicator attachment will be constructed of four plastic parts including the body member, the roller core and cover of suitable relatively rigid resinous plastic, and a roller hollow cylinder 52 of foam rubber, other suitable material may be utilized therefor.

In use, on purchasing a bottle of cosmetic such as suntan lotion, the cap of the suntan lotion bottle may be removed and the applicator attachment 10 screwed into the opening in the suntan lotion container whereby on inverting the container, the channel 28 and the opening 32 will be filled with the suntan lotion which may be applied to a body portion by contacting the body portion with the portion of the roller extending out of the applicator attachment with the cover removed therefrom and moving the lotion container and applicator attachment over the body portion to cause the roller to rotate due to the frictional engagement between the roller and body portion.

After sufficient lotion has been applied to the body portion, the cover may be replaced on the applicator attachment and the lotion stored without danger of losing the lotion or contaminating other articles with the lotion or having the applicator itself contaminated with sand or the like usually found in places where suntan lotion is used.

The advantages of the applicator attachment are obvious in that it is particularly simple and economical to manufacture. Further, it will be understood that the applicator can be re-used and that rollers therein may be replaced. Also, the efficiency of the applicator in placing cosmetics such as suntan lotion on body portions without the abrasive action normally encountered by rubbing suntan lotion on a body portion which may have sand grains thereon is eliminated due to the rolling action of the applicator in place of rubbing and the abrasive action of such rubbing.

While one embodiment of the applicator attachment of the invention has been considered in detail, it will be understood that other embodiments and modifications of the invention are contemplated by the inventor. It is the invention to include all modifications and embodiments as are defined by the appended claims within the scope of the invention.

What I claim as my invention is:

1. An applicator for dispensing cosmetics such as suntan lotion and the like comprising a body member, an elongated slot in one side of the body member having a width and a length, and resilient roller means rotatably mounted on the body member in the slot and extending radially from the slot having a diameter and length at the width and length of the slot slightly larger than the width and length respectively of the slot whereby the roller means is under compression across the width and length of the slot, and means for directing the cosmetic through the body member onto the roller over the greater portion of the surface thereof with the applicator inverted to place the roller lower than the cosmetic container on rotating the roller in frictional engagement with a body portion.

2. Structure as set forth in claim 1, wherein the applicator is an attachment for a cosmetic container and the body member includes means for securing the body member to the cosmetic container.

3. Structure as set forth in claim 2, wherein the means for securing the body member to a cosmetic container comprises a threaded opening in the body member.

4. Structure as set forth in claim 3, wherein the means for directing cosmetic from the cosmetic container onto the roller comprises a distribution channel in the body member extending longitudinally of the slot inwardly of the slot which connects with the threaded opening, and arcuate sides extending from the top of the longitudinal sides of the distribution channel to the longitudinal sides of the slot.

5. Structure as set forth in claim 1, wherein the means for directing cosmetics from the cosmetic container further includes a panel extending across the threaded opening at the top of the distribution channel over approximately the central one-third of the distribution channel having a central opening therein.

6. Structure as set forth in claim 2, wherein the means for rotatably mounting the roller in the body member comprises internal hemispherical recesses in the body member at the ends of the slot and hemispherical bearing bosses on each end of the roller.

7. Structure as set forth in claim 2, wherein the roller comprises a relatively rigid cylindrical core and a relatively soft outer hollow cylinder sleeved over the core.

8. An applicator attachment for dispensing cosmetics such as suntan lotion and the like comprising a body member including means for securing the body member to a container for the cosmetic comprising a threaded opening extending into the body member, an elongated slot forming one side of the body member having side and end walls opposite the threaded opening therein, cylindrical roller means positioned within and extending radially outwardly of the body member through said slot, which roller means is a two-part member having a substantially rigid cylindrical core and a resilient cosmetic absorbent, hollow cylinder sleeved over the core, said roller means being of larger transverse dimension at the slot than the slot with the roller means positioned within the slot so that the roller means is placed in radial compression by the side walls of the slot over a portion of its circumference whereby the slot is sealed longitudinally except for material absorbed by the resilient cosmetic absorbing portion of the roller means, said resilient cosmetic absorbent portion of the roller means also being of greater axial extent at the slot than the longitudinal dimension of the slot whereby the roller means is also placed under axial compression by the end walls of the slot and the ends of the slot are sealed by the roller means except for material absorbed by the roller means, said slot further including structure therein for directing a cosmetic from a container through the opening in the body member onto the roller means over the greater portion of the surface thereof with the applicator attachment inverted to place the roller means lower than the container on rotating the roller means in frictional engagement with a body portion including a metering channel extending longitudinally of the slot in communication with the opening through the body member and a centrally located partition between the metering channel and the roller means which has an opening centrally thereof and which extends over substantially the central third of the length of the slot, said side walls of the slot extending from the longitudinal edges of the metering channel to the longitudinal edges of slot having substantially the same radius of curvature as the roller, hemispherical bearing bosses on the ends of the cylindrical core of the roller means, and hemispherical recesses at the ends of the slot for receiving the bearing bosses to rotatably mount the roller on the container with the roller means under radial and axial compression.

9. Applicator attachment structure as set forth in claim 8 and further including an exterior peripheral groove about the sides of the body member adjacent the slot and a cover for the slot including an open side having a flange including a locking ridge thereon extending inwardly thereof completely around the periphery thereof adapted to fit within the peripheral groove on the body member whereby the cover is held in place on the container on engagement of the locking ridge of the flange with the peripheral groove on the container.

* * * * *